US006194692B1

(12) United States Patent
Oberle

(10) Patent No.: US 6,194,692 B1
(45) Date of Patent: Feb. 27, 2001

(54) ELECTRIC HEATING SHEET AND METHOD OF MAKING THE SAME

(75) Inventor: Robert Oberle, East Windsor, NJ (US)

(73) Assignee: Engelhard Corporation, Iselin, NJ (US)

( * ) Notice: Under 35 U.S.C. 154(b), the term of this patent shall be extended for 0 days.

(21) Appl. No.: 09/165,867

(22) Filed: Oct. 2, 1998

(51) Int. Cl.[7] ..... H05B 3/16
(52) U.S. Cl. ..... 219/543; 219/528
(58) Field of Search ..... 219/543, 528, 219/525, 541; 427/122; 252/502; 217/213, 549, 435, 436

(56) References Cited

U.S. PATENT DOCUMENTS 4,534,886 * 8/1985 Kraus et al. ..... 252/502
4,626,664 * 12/1986 Grise ..... 219/525
4,656,339 * 4/1987 Grise ..... 219/528
4,749,844 * 6/1988 Grise ..... 219/541
4,849,255 * 7/1989 Grise ..... 427/122
5,229,582 * 7/1993 Graham ..... 219/541
5,824,996 * 10/1998 Kochman et al. ..... 219/529

* cited by examiner

*Primary Examiner*—Teresa Walberg
*Assistant Examiner*—Quang Van
(74) *Attorney, Agent, or Firm*—Stephen I. Miller

(57) ABSTRACT

An electric heating sheet (10) includes a heating element (16) formed of a first cured conductive coating disposed on a substrate (12). A pair of electrodes (18) may be disposed at opposite ends of the heating element (16) and in electrical contact therewith. The electrodes (18) may be formed of a second cured conductive coating and one or more elements for configuring current distribution throughout the heating element may also be provided. A first layer (20) formed of an electrically insulating material may be disposed over the electrodes (18) and the heating element (16). A method of manufacturing the heating sheet is also presented.

17 Claims, 2 Drawing Sheets

ELECTRIC HEATING SHEET AND METHOD OF MAKING THE SAME

BACKGROUND OF THE INVENTION

1. Field of the Invention

The present invention relates to electric heating sheets and, in particular, to flexible electric heating sheets of the type used to heat articles such as seats in automobiles, trucks, other vehicles, aircraft and the like.

2. Related Art

Planar heating elements have been used for such applications as automobile seat heating, ceiling heating, underfloor heating, wood/panel heating, motor vehicle mirror and personal cushion heating. Automobile seats have been heated, for example, by flexible elements which are fabricated by bonding an insulated resistor wire to the internal surface of a fabric or leather covering of the seat. The wire is typically made of nickel/chromium or another suitable high-resistance metal. Heat is generated by power dissipated during the passing of current through the wire. The power dissipated is given by the expression: $P=I^2R=VI$ where P is the power dissipated (watts), R is the resistance of the heating element (ohms), I is the current running through the element (amperes) and V is a voltage drop in the heating element (volts). A problem arises in that the heating surface of the wire occupies generally only one to five percent of the surface area required to be heated. Because of the high power required to heat the entire surface from the narrow wire, hot spots are created on the surface which may cause premature deterioration of the fabric or leather covering.

Attempts have been made to ameliorate the aforementioned problem. For example, U.S. Pat. No. 5,229,582 to Graham, issued Jul. 20, 1993, discloses a flexible heating element constructed by securing a flexible layer of conductive material constituting an electric heater to a flexible sheet. The layer of conductive material is connected to an electrical supply means by at least one copper strip (column 2, line 22) electrode that has an embossed surface with protuberances which are said to enhance direct contact of the electrode with the layer of conductive material. A thermoplastic polymer-based adhesive at the interface between the embossed surface and the conductive layer secures the latter to the electrode. The protuberances are provided to penetrate the adhesive layer to provide an improved electrical contact between the electrode and the conductive material.

U.S. Pat. No. 5,629,073 to Lovell, issued May 13, 1997, which discloses a medium-temperature conductive resistive article made from a composition including graphite suspended in a high-temperature polymer base activator with water. The conductive resistive composition can be applied as a layer to a fabric-like substrate in order to provide a resistive temperature adjustable heating element for the fabric. Conductive strips of copper foil "as well as many other types of electrodes" (column 3, line 15) are connected to the heating element as electrodes.

SUMMARY OF THE INVENTION

In accordance with the present invention there is provided an electric heating sheet comprising the following components. A heating element comprises a first cured conductive coating. At least a pair of electrodes comprised of a second cured conductive coating are spaced apart from each other and disposed in electrical contact with the first cured conductive coating of the heating element. A substrate on which the heating element and the electrodes are disposed and a first insulating layer may be provided which substantially covers the electrodes and the heating element.

In accordance with another aspect of the present invention there is provided an electric heating sheet comprising the following components. A heating element comprising a first cured conductive coating. At least a pair of electrodes spaced apart from each other and disposed in electrical contact with the first cured conductive coating of the heating element. One or more current distributing elements of greater conductivity than the first cured conductive coating are disposed in electrical contact with the first cured conductive coating of the heating element, the current distributing elements being dimensioned and configured to influence the pattern of current distribution through the heating element. A substrate may be provided, on which the heating element, the electrodes and the current distributing elements are disposed. A first insulating layer substantially covers the heating element, the electrodes and the current distributing elements.

The following additional aspects of the invention may apply singly or in combination of any two or more thereof. The current distributing elements may optionally comprise a third cured conductive coating; the current distributing elements may be dimensioned and configured to enhance the uniformity of current distribution through the heating element and may be located on the heating element; the electrodes may, and preferably do, have a higher conductivity than that of the heating element; and the electrodes may be disposed at respective opposite ends of the heating element and be located on the heating element. Further, the substrate may be formed of thermoplastic adhesive and may further comprise a backing material on which the substrate is supported. Still further, the electrodes may be of elongate configuration and extend longitudinally substantially parallel to each other, with the current distributing elements comprising a pair of elongate balance bars spaced apart from and substantially parallel to both each other and to the electrodes, with the balance bars being disposed between the electrodes.

Another aspect of the present invention includes providing a second insulating layer which cooperates with the first insulating layer to sandwich therebetween and cover the conductive coatings, and wherein at least one of the first and second insulating layers comprises a thermoplastic adhesive.

Yet another aspect of the present invention includes the sheet being sufficiently flexible to allow it to conform to an irregular surface in the manner in which a woven fabric conforms to an irregular surface.

Still other aspects of the invention include one or more of the following, alone or in any combination of two or more thereof. At least one of the cured conductive coatings may comprise a coating containing at least one particulate conductive material selected from the group consisting of copper, nickel, graphite, tin oxide doped with indium, and silver suspended in a layer of one or more cured polymers selected from the group consisting of polyamides, polyesters, natural rubbers, synthetic rubbers, polyimides and elastomers; the particulate conductive material may comprise from about 20% to about 50% by volume of the coating; the particulate conductive material may comprise silver; and the particulate conductive material may comprise from about 33% to about 50% by volume of the coating.

In accordance with a method aspect of the present invention, there is provided a method of making an electric heating sheet comprising the following steps. A first conductive ink comprising a suspension of first particulate conductive material in a first curable liquid is deposited onto a substrate and is cured on the substrate to form a first cured conductive coating comprising a heating element. A second conductive ink comprising a suspension of second particulate conductive materials in a second curable liquid is deposited in contact with the first cured conductive coating in a pattern defining at least a pair of spaced-apart areas coated with the second conductive ink. The second conductive ink is cured in contact with the cured first conductive ink to provide a second cured conductive coating comprising disposed electrodes in electrical contact with the first conductive coating. A first layer of an electrically insulating material is deposited over the first and the second cured conductive coatings to substantially cover the same to form a layered electric heating sheet.

In accordance with another method aspect of the present invention there is further provided a method of making an electric heating sheet comprising the following steps. A first conductive ink comprising a suspension of a first particulate conductive material in a first curable liquid is deposited onto a substrate and is cured to form a first cured conductive coating on the substrate comprising a heating element. At least a pair of electrodes is placed in electrical contact with the first cured conductive coating. One or more current distributing elements is disposed in contact with the first conductive ink or the first cured conductive coating obtained therefrom. The current distributing elements have a conductivity greater than the first cured conductive coating to thereby affect current distribution through the first cured conductive coating. A first layer of an electrically insulating material is deposited over the first conductive coating, the electrodes and the current distributing elements to substantially cover the same, to form a layered electric heating sheet.

Another method aspect of the invention comprises forming the current distributing elements by depositing a third conductive ink comprising a suspension of a third particulate conductive material in a third curable liquid in contact with the first cured conductive ink in a selected pattern.

Yet another method aspect of the invention calls for the step of placing the electrodes in electrical contact with the first cured conductive coating by depositing a second conductive ink comprising a suspension of a second particulate conductive material in a second curable liquid into contact with, e.g., onto, the first cured conductive coating. Another aspect provides that the second conductive ink has a conductivity greater than that of the first conductive ink. Still another aspect provides that the current distributing elements are dimensioned and configured to enhance the uniformity of current distribution through the first cured conductive coating.

In accordance with yet another method aspect of the present invention there is still another method of making an electric heating sheet comprising the following steps. A first conductive ink comprising a suspension of first particulate conductive material in a first curable liquid is deposited onto a substrate in a pattern defining at least a pair of spaced-apart areas coated with the first conductive ink. The first conductive ink may be cured on the substrate to form a first cured conductive coating comprising electrodes. A second conductive ink comprising a suspension of second particulate conductive material in a second curable liquid may be deposited in contact with the first cured conductive coating. The second conductive ink may be cured in contact with the cured first conductive ink to provide a second cured conductive coating comprising a heating element in electrical contact with the first conductive coating. A first layer of an electrically insulating material may be deposited over the first and the second cured conductive coatings to substantially cover the same, to form a layered electric heating sheet.

A further method aspect of the present invention for making an electric heating sheet comprises the following steps. One or more current distributing elements are located on a substrate. A first conductive ink comprising a suspension of first particulate conductive material in a first curable liquid may be deposited in contact with the current distributing elements. The first conductive ink may be cured to form a first cured conductive coating comprising a heating element. Advantageously, the current distributing elements have a conductivity greater than the first cured conductive coating to thereby affect current distribution through the first cured conductive coating. At least a pair of electrodes are placed in electrical contact with the first cured conductive coating. A first layer of an electrically insulating material is deposited over the first conductive coating, the electrodes and the current distributing elements to substantially cover the same, to form a layered electric heating sheet.

Yet a further method aspect of the present invention for making an electric heating sheet comprises the following steps. One or more current distributing elements are located on a substrate and at least a pair of electrodes may be deposited onto the substrate. A first conductive ink comprising a suspension of first particulate conductive material in a first curable liquid may be deposited in contact with the current distributing elements and the electrodes. The first conductive ink may be cured to form a first cured conductive coating on the substrate comprising a heating element. Advantageously, the current distributing elements have a conductivity greater than the first cured conductive coating to thereby affect current distribution through the first cured conductive coating. A first layer of an electrically insulating material may be deposited over the first conductive coating, the electrodes and the current distributing elements to substantially cover the same, to form a layered electric heating sheet.

DETAILED DESCRIPTION OF THE INVENTION AND SPECIFIC EMBODIMENTS THEREOF

A conductive ink such as those which are useable in the practices of the present invention is comprised of a suspension of a conductive phase comprised of particulate conductive material dispersed in a curable liquid such as a polymeric binder phase and an alcohol. The conductive ink may be applied as a coating on a substrate or on a cured layer of conductive ink, and then cured. Thus, as used herein and in the claims, the term conductive ink applies to a liquid material, as described above, with or without a pigment, which is readily cured and, when cured, conducts electricity.

Figure 1:
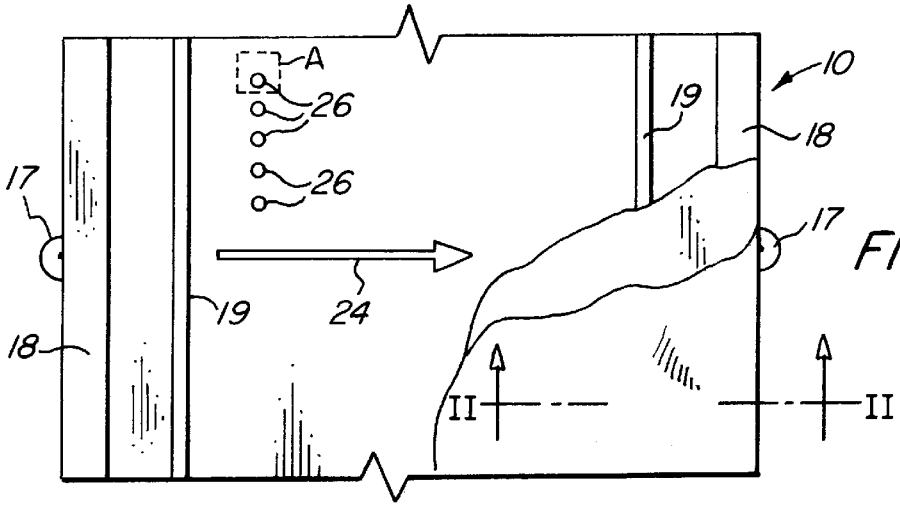
FIG. 1 is a plan view of a portion of an electric heating sheet in accordance with one embodiment of the present invention.
Figure 2:
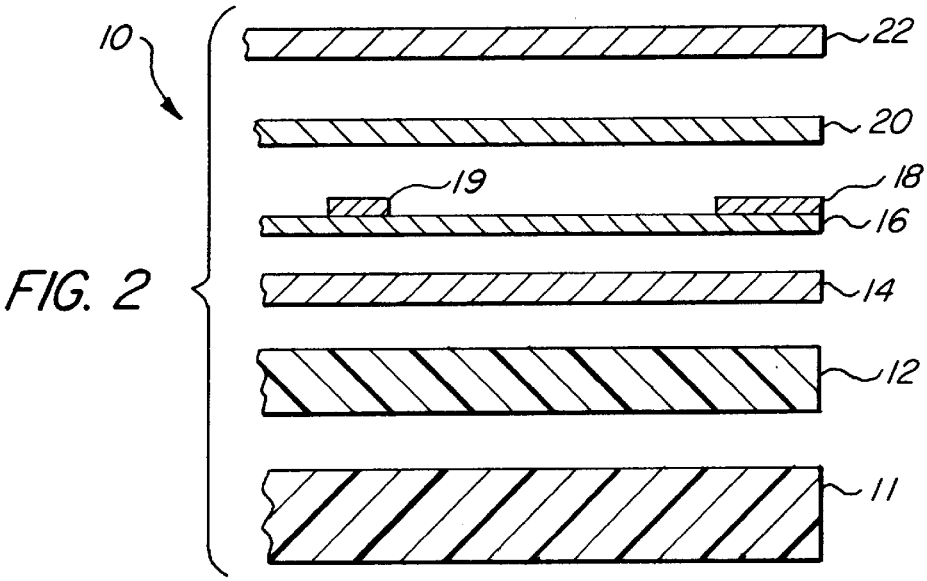
FIG. 2 is an exploded view, enlarged relative to FIG. 1, taken along line II—II of FIG. 1.

As shown in FIGS. 1 and 2, an electric heating sheet suitable for being used in the construction of an electrically heated seat and made in accordance with an embodiment of the present invention may comprise a flexible and thin layered material. Such a heating sheet may be placed, for example, beneath the fabric, leather or vinyl covering of an automobile seat (not shown). The electric heating sheet is shown generally at 10 in FIGS. 1 and 2 and comprises an optional backing material 11, a substrate 12, an optional second insulating layer 14, a heating element 16, a pair of electrodes 18 disposed in electrical contact with the heating element 16, a current distributing element 19, a first insulating layer 20, and a covering 22 of, e.g., a fabric, leather, vinyl or the like material. Covering 22 may thus comprise the outer covering of a warmable seat. It will be understood that the particular order of the various elements on the substrate is shown for illustrational purposes and may vary. For example, the electrodes 18 or the current distributing element 19 may be disposed on the substrate 12 with the heating element 16 disposed thereon or therebetween.

The thickness of the backing material 11 may vary depending upon the application, although it is preferably on the order of about ¼ inch (0.64 cm).

The covering 22 is not necessary for practicing the present invention, but is illustrated in order to show the relationship of the electric heating sheet 10 of the invention to the decorative and wearing covering of a structure such as a seat back and/or seat cushion in which the electric heating sheet 10 may be incorporated.

The first insulating layer 20 and optional second insulating layer 14 may be formed of any suitably flexible material such as a plastic which functions to electrically insulate the heating element 16 and electrodes 18. One suitable material was found to be a polyamide resin, although the first insulating layer 20 and second insulating layer 14 are preferably formed of a thermoplastic adhesive. The thermoplastic adhesive may be formed from any suitable thermoplastic polymer, for example, polyethylene, polyurethane, polystyrene or polypropylene. One thermoplastic adhesive suitable for use in the present invention is sold as Bemis Associates Product No. 4220 by Bemis Associates of Shirley, Mass. The advantage of using of a thermoplastic adhesive as insulating layers 14 and 20 lies in the ability of such adhesives to laminate and adhere the materials together in the form of a sandwich about the heating element 16. Additionally, the cured thermoplastic adhesive is flexible so as to bend and conform both to the shape and contours of the seat or other structure in which it is used, and to the changes in shape and contour caused when a person sits thereon, as when the heating sheet 10 is used to heat an automobile seat or seat cushion. Obviously, other suitable materials may be used and an adhesive or other suitable means may be employed to hold the layers together.

The substrate 12 may be formed of any suitable material such as paper or plastic but is preferably formed of a thermoplastic adhesive similar to that, and for the reasons, discussed above. In one embodiment of the present invention, the substrate 12 functions as the second insulating layer so that second insulating layer 14 of the illustrated embodiment may be eliminated.

The electrodes 18, only one of which is shown in FIG. 2, are disposed on the outer edges of the heating element 16 as seen in FIG. 1, and are formed of any suitable highly conductive material. Suitable materials include one or more of copper, silver, or other conductive metal foils. However, in a preferred embodiment of the present invention, the electrodes are formed of a second cured conductive coating obtained from a conductive ink which may be applied directly onto the heating element 16 or onto a substrate (not shown) and in contact with the heating element 16 and cured to provide a second cured conductive coating comprising the electrodes 18. The electrodes 18 may advantageously, but not necessarily, be made thinner than sheet metallic material (foils), and are more flexible than such foils, as is more fully discussed below. The electrodes 18 include power source connections 17 which are each connected by suitable leads (not shown) in a known manner to a power source (not shown) for energizing the heating element 16.

It is important for certain applications to provide an even heating of the heating element 16 by, e.g., preventing hot spots as discussed hereabove. Since it is known that high concentrations of current cause hot spots, an attempt to alleviate this problem was made by disposing electrodes along the entire opposite edges of the heating element 16, as illustrated in FIG. 1. However, because of the location of the power source connections 17, incontinuities, impurities and/or the incomplete mixing of materials in the conductive ink, it has been found that the current concentration often still varies across the heating element 16. In particular, it has been found that current tends, e.g., to be concentrated directly between the power source connections 17 as indicated by arrow 24 and along various other paths through the heating element 16. Accordingly, a further reduction in, and/or a better control over, the concentration of current and, in turn, hot spots, would be advantageous.

In accordance with one feature of the present invention, current distributing elements 19 are employed in such a manner as to, optionally, more uniformly distribute current through the heating element 16 or redistribute current as desired to a particular location in the heating element 16 as will be more fully discussed hereafter. Referring again to FIG. 1, the direction of current flow as shown by arrow 24 is generally perpendicular to the longitudinal direction of the electrodes 18. It has been found that by employing current distributing elements 19 in the form of a pair of parallel bars as shown in FIG. 2, the current is more uniformly distributed across the entire surface of the heating element 16, in turn providing a more even heating thereof. This pair of parallel bars are referred to herein and in the claims as "balance bars." It will also be appreciated that other patterns may also be employed to accomplish this such as an arcuate shape (not shown) of current distributing elements 19. In the illustrated embodiment, current distributing elements 19 are spaced apart from and parallel to each other and to electrodes 18, and are disposed between the electrodes 18.

Figure 1A:
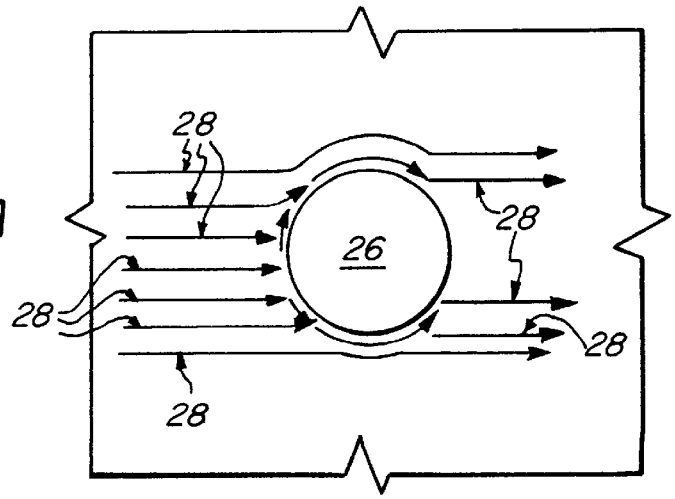
FIG. 1A is a view, greatly enlarged relative to FIG. 1, of approximately the area bounded by the square A in FIG. 1.
Figure 1B:
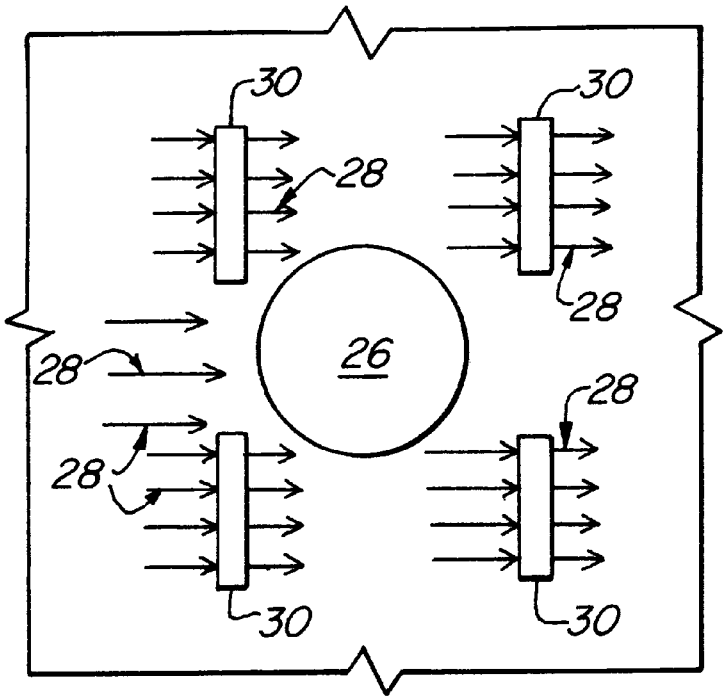
FIG. 1B is a view corresponding to FIG. 1A but of another embodiment of the present invention.

One example of an discontinuity which causes local concentration of current within the heating element 16 is where there is a stitch line with holes 26 (FIG. 1) punched through the heating element 16. Because of the holes 26, voltage gradients and current paths are formed around the holes. As shown in FIG. 1A, it has been found that where a particularly large discontinuity, such as a hole 26, is formed (by stitching holes, or a cut-out) in the heating element 16, current travels around the hole 26 as shown by arrows 28, increasing the temperature of the heating element 16 along the areas where the current is concentrated. As shown in FIG. 1B, in order to spread out the concentrated current flow, current distributing elements 30 are provided which have the effect of reducing these voltage gradients and redistributing current flow in a more uniform maimer across heating element 16 by pulling the current away from the peripheral edge of the hole 26. The current distributing elements 30 may be, as illustrated, disposed parallel to each other in generally straight bars which are each vertically spaced next to the hole 26 to more uniformly configure the current distribution, and thus the thermal distribution, around the hole 26. Obviously, other configurations and placement of current distributing elements may be used to meet the needs of a given case. Current distributing elements may also be used in a case in which it is desired to provide greater current flow in a given area of the heating element 16.

The heating element 16, the electrodes 18 (optionally) and/or the current distributing elements 19 and 30 may each be advantageously formed of cured conductive coatings. For example, one advantage in forming the electrodes 18 and current distributing elements out of cured conductive coatings resides in the fact that the coatings are each a better match for thermal expansion with the heating element 16 than metal foils discussed above. The cured conductive coatings may be made of a suspension of a particulate conductive material in a curable plastic binder and a solvent such as alcohol to form a conductive ink. The viscosity of such liquid suspensions may be adjusted by alcohol or any suitable solvents so that they are readily painted or printed onto a substrate and then cured to form a solid, cured coating. The curing may be effectuated by any known means including heat, ultraviolet ("UV") radiation, etc. Depending upon the desired conductivity of the cured coating, fine particles of a metal or mixtures of metals may be employed. Suitable metals include copper, nickel, graphite and tin oxide with a suitable dopant such as indium to increase conductivity. In particular, varying concentrations of silver and other metals may be employed which, as is well known, provide various conductivities and, inversely, various resistivities. For example, a high resistivity coating is required for the heating element 16 to thereby generate a suitable amount of heat. This is because the heat generated is directly related to the power (P) dissipated which, in turn, is dependent on a resistance of the material through the formula:

$$P=I^2R,$$

where I is the current; R is the resistance.

And, resistance is related to resistivity (ρ) through the formula:

$$R=\rho L/A,$$

where L is length of the material; A is the cross-sectional area.

To formulate a conductive coating having a higher resistivity, a higher percentage of a particulate material having a lower conductivity, for example, graphite, alone or in combination with another metal may be employed in the ink. When formulating a relatively higher conductivity ink for use for either the electrodes or for current distribution elements, a larger percentage of higher conductivity particles, e.g., silver, may be employed. Accordingly, it has been found that the formulations of the inks for the heating element, the electrodes and the current distribution elements have been found to be most effective when the heating element is formed of a lower conductivity material than either that of the electrodes 18 or the current distributing elements 19 and 30. Stated otherwise, the electrodes 18 and the current distributing elements 19 and 30 normally require a higher conductivity than the heating element 16. Accordingly, electrodes 18 and current distributing elements 19 and 30 may be formed by, for example, use of silver in the conductive phase of the ink and the heating element 16 could, for example, be made from an ink which employs a conductive phase of a silver and graphite mixture.

The curable liquid, which may be referred to as a binder phase, functions to provide the cohesiveness and flexibility of the conductive coating after curing and is preferably formed of a plastic (synthetic organic polymeric) material. The binder phase should also have a glass transition ($T_g$) temperature which is higher than the temperature induced in the heating element 16 by the heat generated by the conductive phase when the latter is energized. The glass transition temperature of a material is the temperature at which the material changes from a vitreous state to a plastic state. It has been found that the glass transition temperature of the material should preferably be over 120° C. for seat heating (and some other) applications. One plastic material having a suitably high glass transition temperature is polyamide which also has been found to be very flexible when cast as a coating onto a substrate. Polyamide is also not easily degraded by contact with solvents or other chemicals. Suitable polyamides include nylons, preferably, but not necessarily, of a medium (from about 6,000 to 10,000) molecular weight. Other polymers that may be used as a binder are polyesters also having a glass transition temperature of at least about 120° C., natural or synthetic rubbers and polyimides.

Another class of polymers which may be utilized as the binder phase is elastomers. The use of an elastomer in, e.g., a heating element, is advantageous where a set temperature level of the heating element is not to be surpassed for safety or other reasons. In particular, when the glass transition temperature of the elastomer is surpassed, the elastomer expands. This expansion may be taken advantage of since, depending on the volume of conductive material combined with the elastomer, the expansion will reduce the ability of the heating element to conduct electricity. Thus, a heating element formed with an elastomer would, upon sufficient energization, heat up to the elastomer's glass transition temperature, expand, and then cool because of the resultant reduction in conductivity, until sufficient conductivity is restored, and then heat up again. This heating and cooling cycle would continuously repeat and thereby provide a relatively stable temperature conductive coating. Suitable elastomers include styrene-butadiene co-polymer, polychloroprene, nitrilic rubber, butyl rubber and silicon rubber.

The conductive phase and binder phase should be formed in proportions which overcome what is known to those skilled in the art as the percolation threshold. As used herein, the percolation threshold provides an approximate proportion of conductive phase required to have the cured coating conduct electricity and the proportion of binder phase required to retain the cured coating in a cohesive state. It has been found that in the present case, the percolation threshold for conductivity requires at least approximately 25% of the composition be conductive phase, for example, the composition should be approximately 25% to 50% by volume conductive phase and, most preferably, 33% to 50% by volume conductive phase. It has been found that when the volume fraction of conductive phase exceeds 75% of the composition, the binder no longer is sufficiently cohesive and the structure tends to weaken. For a detailed discussion of percolation theory, see, for example, Zallen, *The Physics of Amorphous Solids,* Wiley Interscience, John Wiley and Sons, New York, N.Y., 1983.

An aromatic alcohol such as benzyl alcohol may be used in combination with the conductive phase and binder phase to provide a conductive ink which is easily cured by heat. Additionally, a suitable surfactant such as that sold under the trademark TYZOR AA by E.I. DuPont de Nemours a Company of Wilmington, Del., along with a thickener such as that sold under the trademark CAB-O-SIL by Cabot Corporation of Billerica, Mass., may be employed. Suitable exemplary formulations for conductive coatings usable for the present invention are illustrated in the TABLES provided hereinafter.

In accordance with an important feature of the present invention, by dispersing the conductive phase and binder phase in alcohol in amounts which render the resulting suspension the approximate consistency of ink ("the ink"), it may be readily printed on a substrate in any desired pattern using standard printing techniques such as screen printing.

Figure 3:
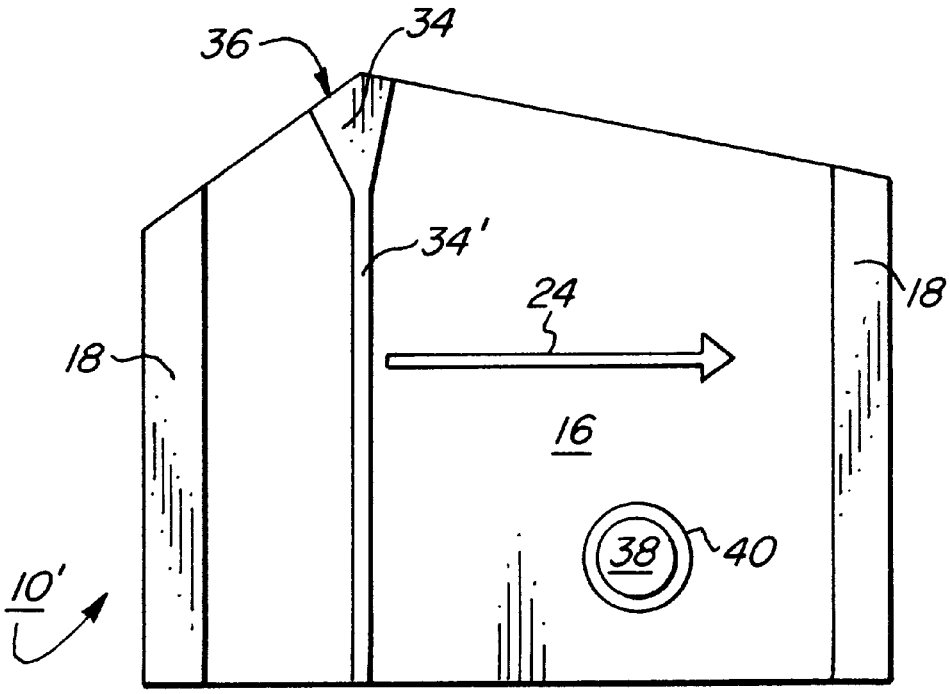
FIG. 3 is a plan view of a portion of an electric heating sheet in accordance with a third embodiment of the present invention.

Another embodiment is illustrated in FIG. 3, wherein an irregularly shaped heating sheet 10' is provided. The irregular shape may be needed to conform to the shape of a structure, such as a seat back or cushion, on which heating sheet 10' is to be used. A voltage is applied between the electrodes 18 and, as is well known, current travels in the direction of arrow 24. Because, as is generally known, current will travel along the path of least resistance between the electrodes 18, a tip or angular portion 36 will have little or no current traveling therethrough and will remain cooler than the rest of the heating element 16. In order to alleviate this problem it has been found that the presence of a current distributing element 34 within the angular portion 36 tends to draw current into the latter, thereby evening the heating throughout the entire heating element 16. It will be understood that the dimension, location and geometrical shape of the current distributing element 34 may vary in accordance with the desire to draw current for varying and/or evening the heating pattern of the heating element 16. For example, a single bar 34' may also be employed to facilitate further evening of current flow throughout the heating element 16. In another example, if it is desired that a particular portion 38 of the heating element 16 should remain at a lower temperature than the rest of the heating element 16, then a current distributing element 40 in the shape of a ring may be employed to reduce the temperature within the ring. Electrical energy is drawn into the ring 40 away from the portion 38 of heating element 16, thereby reducing the temperature in the particular portion.

A method of forming the heating sheet 10 is now presented. An insulator, such as a thermoplastic adhesive, may be provided as a substrate 12 and a first conductive ink may be screen-printed or otherwise applied in a selected pattern thereon. Electrodes 18 may be composed of a metallic foil and placed in electrical contact with the first conductive ink at opposite edges of the printed area. The electrodes 18 may, optionally, be made of a second conductive ink which may be applied or printed onto the heating element 16. Optionally, the electrodes 18 may be printed and cured before, contemporaneously with or at a later time as the heating element 16 and may form either one layer, or two layers, with the heating element 16 on the substrate 12. Current distribution elements 19 (FIG. 1), 30 (FIG. 1B), 34 (FIG. 3) may also be made of a metallic foil and placed in electrical contact with the first conductive ink. Alternatively, the current distribution elements may be composed of a third conductive ink which may be applied or printed onto the heating element 16. Optionally, the current distributing elements 19, 30, 34 may be, e.g., printed and cured, before, at the same time or at a later time than the heating element 16, and thus may either form one layer or two layers with the heating element 16 on the substrate 12. A first insulating layer 20 such as a thermoplastic adhesive may be placed over the printed area and a backing material 11 may be placed on the bottom. The entire structure may then be laminated together, for example, by applying heat thereto to set the adhesive layers.

TABLE I

The following materials were used to formulate a conductive ink used to make cured conductive coatings for the heating element and the electrodes.

| Material | Amounts | |
|---|---|---|
| | Electrodes | Heating Element |
| Polyamide Resin (50% alcohol solution) | 4.00 g | 4.00 g |
| Silver Powder | 13.20 g | 9.00 g |
| Graphite Powder | — | 1.61 g |
| TYZOR AA (DuPont C.) | 0.08 g | 0.08 g |
| Benzyl Alcohol | — | 3.83 g |

TABLE II

Another suitable ink formulation useful for forming the heating element is as follows:

| Material | Amount |
|---|---|
| Polyamide resin (50% alcohol sol.) | 10 g |
| Silver powder | 66 g |
| TYZOR AA (DuPont Inc.) | 0.2 g |
| CAB-O-SIL M5 (Cabot Corp.) | 0.1 g |
| Benzyl alcohol | 12 g |

TABLE III

Another suitable ink formulation useful for forming the heating element is as follows:

| Material | Amount |
|---|---|
| Polyamide resin (50% alcohol sol.) | 40 g |
| Silver powder | 132 g |
| CAB-O-SIL M5 (Cabot Corp.) | 0.2 g |
| Benzyl Alcohol | 1 g |
| Solution of TABLE II | 43 g |

EXAMPLE 1

The formulation of TABLE III was screen printed on a first sheet of thermoplastic adhesive in a nominally 0.0005 inch (0.00127 cm) thick coating. The printed area was approximately 8 inches square (51.61 $cm^2$). Copper foil electrodes approximately 1 cm (0.3937 inch) wide and 0.001 inch (0.00254 cm) thick were pressed into the uncured ink at opposite edges of the printed area. The ink was cured at 105° C. for ten minutes to evaporate the solvent. The cured ink and a first sheet of thermoplastic adhesive was placed on a woven cotton textile obtained from a retail fabric store. A second sheet of thermoplastic adhesive material was placed over the printed area and a square of 0.25 inch (0.635 cm) thick open cell polyurethane foam, obtained from a retail fabric store, was placed on top. The entire structure was then laminated together with a consumer iron (General Electric Light 'n Easy® at the highest heat setting). The completed laminate structure had a resistance of 0.2 ohm.

EXAMPLE 2

The formulation of TABLE III was screen printed on a first sheet of thermoplastic adhesive in a nominally 0.0005 inch (0.00127 cm) thick coating. The printed area was approximately 8 inches square (51.61 $cm^2$). Aluminum foil electrodes approximately 1 cm (0.3937 inch) wide and 0.001 inch (0.00254 cm) thick were pressed into the uncured ink at opposite edges of the printed area. The ink was cured at 105° C. for ten minutes to evaporate the solvent. The ink and first sheet of thermoplastic adhesive was placed on a woven cotton textile obtained from a retail fabric store. A second sheet of thermoplastic adhesive material was placed over the printed area and a square of 0.25 inch (0.635 cm) thick open cell polyurethane foam, obtained from a retail fabric store, was placed on top. The entire structure was then laminated together with a consumer iron (General Electric Light 'n Easy® at the highest heat setting). The completed laminate structure had a resistance of 1.0 ohm.

EXAMPLE 3

A silver/graphite ($\rho=8.3\times10^{-3}$ ohm-cm) conductive ink was printed on a MYLAR sheet. The printed area was 7.5 cm×12.0 cm. A highly conductive silver ink ($\rho=7.4\times10^{-5}$ ohm-cm) was used to print the electrodes and the balance bars over the resistance heater, as shown in FIG. 2.

Although the present invention has been described in detail with respect to specific preferred embodiments thereof, various modifications thereto lie within the spirit and scope of the invention and the claims. For example, although embodiments of the present invention have been described with reference to heating a vehicle seat, it will be understood that the present invention may be employed for heating any suitable material or structure.

What is claimed is:

1. An electric heating sheet, comprising:

a heating element comprising a first cured conductive coating;

at least a pair of electrodes spaced apart from each other and disposed in electrical contact with the heating element to impart a pattern of current distribution through the heating element when electrical current is supplied to the electrodes;

one or more current distributing elements of greater conductivity than the first cured conductive coating disposed in electrical contact with the first cured conductive coating of the heating element, the current distributing elements being dimensioned and configured to influence the pattern of current distribution through the heating element;

a substrate on which the heating element, the electrodes and the current distributing elements are disposed; and a first insulating layer substantially covering the heating element, the electrodes and the current distributing elements.

2. The sheet of claim 1 wherein the current distributing elements comprise a third cured conductive coating.

3. The sheet of claim 1 or claim 2 wherein the current distributing elements are dimensioned and configured to enhance the uniformity of current distribution through the heating element and are located on the heating element.

4. The sheet of claim 1 or claim 2 wherein the electrodes have a conductivity which is higher than the conductivity of the heating element.

5. The sheet of claim 1 or claim 2 wherein the electrodes are disposed at respective opposite ends of the heating element and located on the heating element.

6. The sheet of claim 1 or claim 2 wherein the substrate is formed of thermoplastic adhesive and further comprising a backing material on which the substrate is supported.

7. The sheet of claim 1 or claim 2 wherein the electrodes are of elongate configuration and extend longitudinally substantially parallel to each other, and the current distributing elements comprise a pair of elongate balance bars spaced apart from and substantially parallel to both each other and to the electrodes, and the balance bars are disposed between the electrodes.

8. The sheet of claim 1 or claim 2 further comprising a second insulating layer which cooperates with the first insulating layer to sandwich therebetween and cover the conductive coatings, and wherein at least one of the first and second insulating layers comprises a thermoplastic adhesive.

9. The sheet of claim 1 or claim 2 being sufficiently flexible to allow it to conform to an irregular surface in the manner in which a woven fabric conforms to an irregular surface.

10. The sheet of claim 1 or claim 2 wherein at least one of the cured conductive coatings comprises a coating containing at least one particulate conductive material selected from the group consisting of copper, nickel, graphite, tin oxide doped with indium, and silver suspended in a layer of cured polymer selected from the group consisting of one or more of polyamides, polyesters, natural rubbers, synthetic rubbers, polyimides and elastomers.

11. The sheet of claim 10 wherein the particulate conductive material comprises from about 20% to about 50% by volume of the coating.

12. The sheet of claim 11 wherein the particulate conductive material comprises silver.

13. The sheet of claim 11 wherein the particulate conductive material comprises from about 33% to about 50% by volume of the coating.

14. The sheet of claim 13 wherein the particulate conductive material comprises silver.

15. The sheet of claim 1 or claim 2 wherein the heating element contains at least one discontinuity capable of causing a local concentration of current within the heating element and at least one current distributing element which is dimensioned and configured to enhance the uniformity of current distribution in the vicinity of the discontinuity.

16. The sheet of claim 1 or claim 2 wherein the current distributing elements are disposed between the electrodes.

17. The sheet of claim 1 or claim 2 wherein the current distributing elements are spaced from the electrodes.

* * * * *